US005149203A

United States Patent [19]

Sacks

[11] Patent Number: 5,149,203

[45] Date of Patent: Sep. 22, 1992

[54] BULLET-PROOF BAG

[75] Inventor: Michael Sacks, Manchester, United Kingdom

[73] Assignee: Dowty Armourshield Limited, Manchester, England

[21] Appl. No.: 679,245

[22] Filed: Apr. 2, 1991

[30] Foreign Application Priority Data

Apr. 2, 1990 [GB] United Kingdom ..... 9007347

[51] Int. Cl.[5] ..... B65D 85/00

[52] U.S. Cl. ..... 383/111; 383/110; 206/315.11; 206/317; 220/403; 220/900; 190/125

[58] Field of Search ..... 383/109, 111, 110, 117, 383/119; 190/40, 124, 125; 206/3, 315.11, 317; 220/403, 420, 425, 460, 461, 900; 2/2.5; 428/911

[56] References Cited

U.S. PATENT DOCUMENTS

| | | | |
|---|---|---|---|
| 4,057,359 | 11/1977 | Grooman | 428/911 X |
| 4,091,852 | 5/1978 | Jordan et al. . | |
| 4,301,898 | 11/1981 | Plough et al. | 206/315.11 X |
| 4,509,645 | 4/1985 | Hotta | 383/110 X |
| 4,569,082 | 2/1986 | Ainsworth et al. | 383/110 X |
| 4,573,202 | 2/1986 | Lee | 190/125 X |
| 4,805,776 | 2/1989 | Namgyal et al. | 383/110 X |
| 4,877,131 | 10/1989 | Patros et al. | 206/317 |

FOREIGN PATENT DOCUMENTS

| | | |
|---|---|---|
| 0012334 | 6/1980 | European Pat. Off. . |
| 2803703 | 8/1979 | Fed. Rep. of Germany . |
| 2809168 | 11/1982 | Fed. Rep. of Germany . |
| 655688 | 5/1986 | Switzerland . |
| 2081852 | 2/1982 | United Kingdom . |
| 2207883 | 2/1989 | United Kingdom . |
| 2222667 | 3/1990 | United Kingdom . |

*Primary Examiner*—Stephen Marcus
*Assistant Examiner*—Jes F. Pascua
*Attorney, Agent, or Firm*—Young & Thompson

[57] ABSTRACT

A bag or similar portable container having a wall or walls surrounding an internal space accessible through an opening (4) in the bag, the wall or walls incorporating or being lined with one or more layers (6) of high tensile strength and high stretch resistance material such as to be capable of resisting penetration by a bullet. Preferably, a single multi-layer sheet (6) is used to form the wall or walls (9) by folding the sheet at the corners (32), thereby avoiding joins that would be vulnerable to penetration. Preferably, the penetration resistant material (6) is backed up by one or more layers (11) of an impact absorbing material, such as polycarbonate sheet material and foamed plastics material. The layers of penetration resistance material (6) and impact absorbing material (11) may be separately formed as removable inserts that are used to line the bag.

14 Claims, 3 Drawing Sheets

BULLET-PROOF BAG

FIELD OF THE INVENTION

This invention relates to means for protecting people against injury from guns or bombs.

There are many locations such as hospitals and law courts where authorised carriers of hand guns cannot carry loaded guns. Hand guns then either have to be handed-over for safe keeping or have to be unloaded. In the latter case, a safe area has to be provided in which the guns can be unloaded without the risk of members of the public being injured by accidental firing of the guns.

Also, there are situations where guns are preferably carried in a loaded condition. For example, a gun found at the scene of a crime needs to be removed for tests but should preferably not be interferred with by unloading to make it safe.

OBJECT OF THE INVENTION

An object of the present invention is to provide means in which a gun can be safely loaded or unloaded or transported.

SUMMARY OF THE INVENTION

This is achieved according to the present invention by providing a bag or similar portable container having a wall or walls surrounding an internal space accessible through an opening in the bag, the wall or walls incorporating or being lined with one or more layers of high tensile strength and high stretch resistance material such as to be capable of resisting penetration by a bullet.

A bag which is bullet-proof is a convenient article which can be made readily available whenever there is a need to load or unload or transport loaded guns. It can be used simply for loading or unloading by the carrier of a gun holding the gun in the bag whilst carrying out these operations. If the gun is then fired accidentally, the bullet will be retained by the wall of the bag and not cause injury to any other persons in the locality. Alternatively, a loaded gun or even an explosive device, such as a letter-bomb, can be placed in the bag and safely transported. For convenience, the bag may have handles or carry straps.

A bag suitable for use with hand guns may have the opening in the top of the bag so that a gun handler can see what he is doing in the bag. However, bags suitable for other guns, such as shot-guns or rifles, may have the opening at one end of an elongate bag.

The layers of penetration resistant material may comprise closely woven aramid fabric such as that supplied by Du Pont under their registered trade mark KEVLAR, although other suitable materials may be used. Preferably, a single multi-layer sheet is used to form the wall or walls by folding the sheet at the corners, thereby avoiding joints that would be vulnerable to penetration.

Preferably, the penetration resistant material is backed up by one or more layers of an impact absorbing material, such as polycarbonate sheet material and foamed plastics material.

The layers of penetration resistant material and impact absorbing material may be separately formed as removable inserts that are used to line the bag. Additional penetration resistant panels may be provided locally within the bag in particular applications. For example, a bag used with shot-guns or rifles may have such a panel located adjacent the open end of the barrel, or a panel may be used as a lid over the opening when the bag is used to carry loaded guns or a bomb.

DESCRIPTION OF THE DRAWINGS

The invention will now be described by way of example with reference to the accompanying drawings in which.

MODE OF CARRYING OUT THE INVENTION

Figure 1:
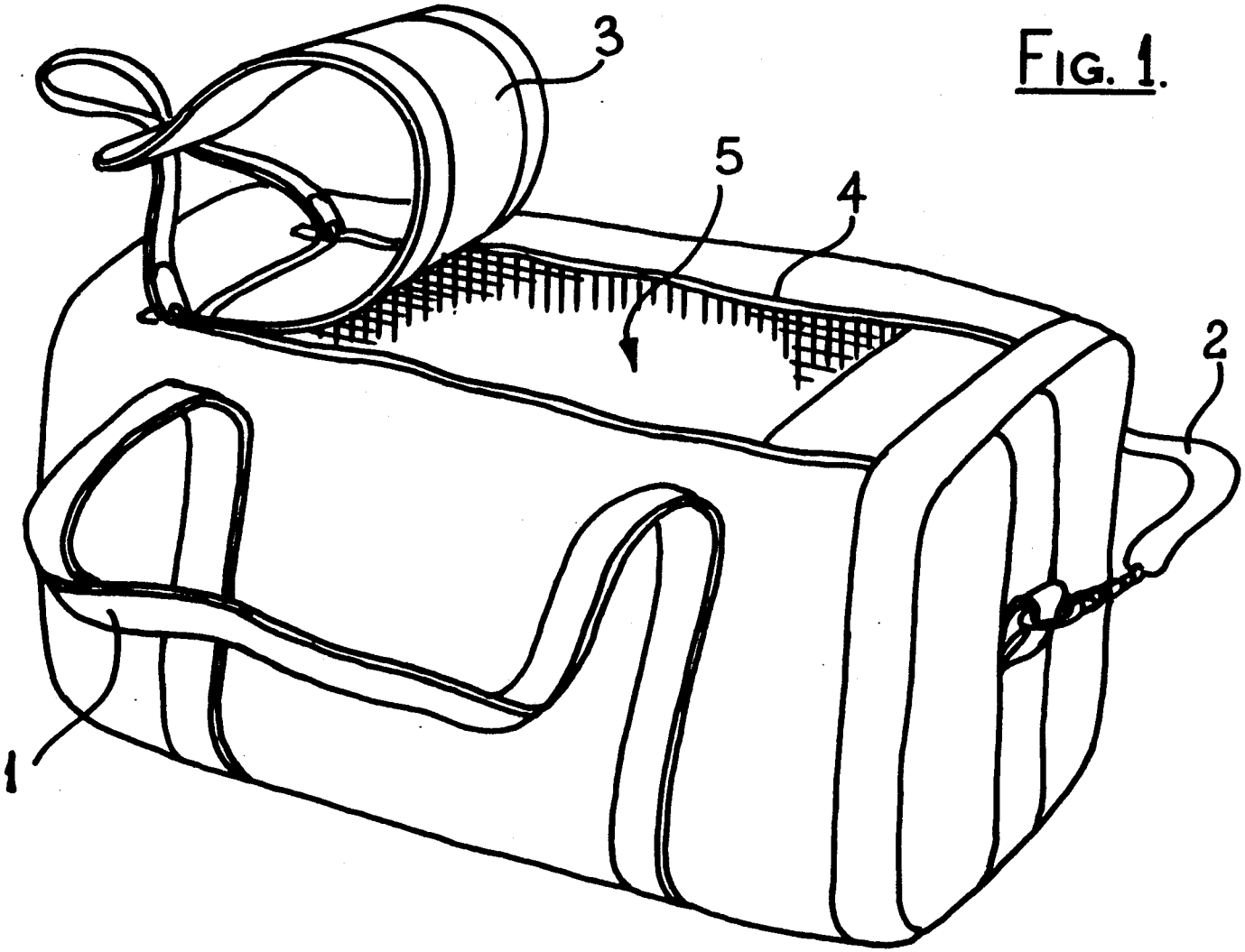
FIG. 1 is a perspective view of a bag according to the invention.
Figure 2:
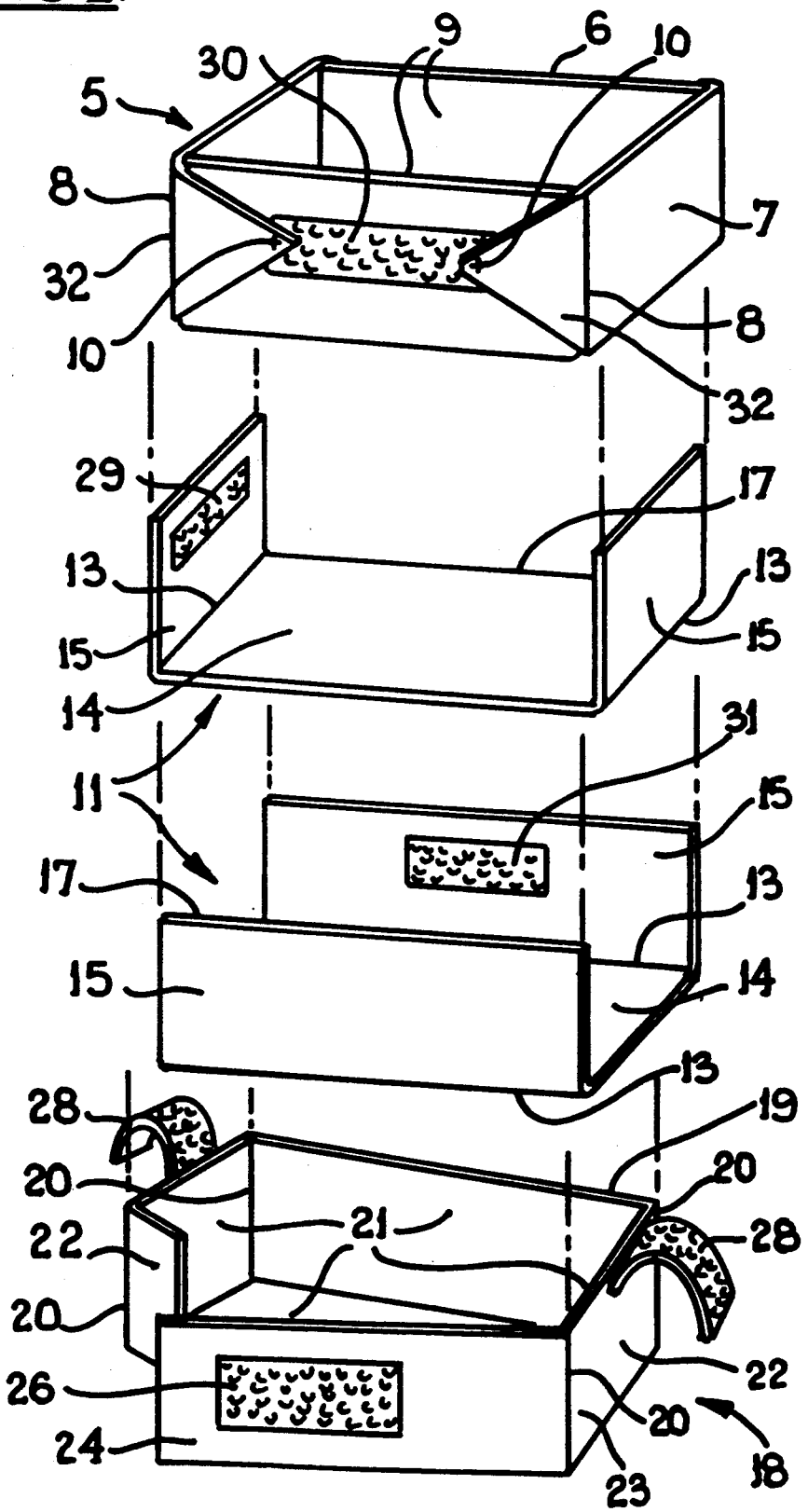
FIG. 2 is an exploded view of the protective inserts provided in the bag of FIG. 1.
Figure 3:
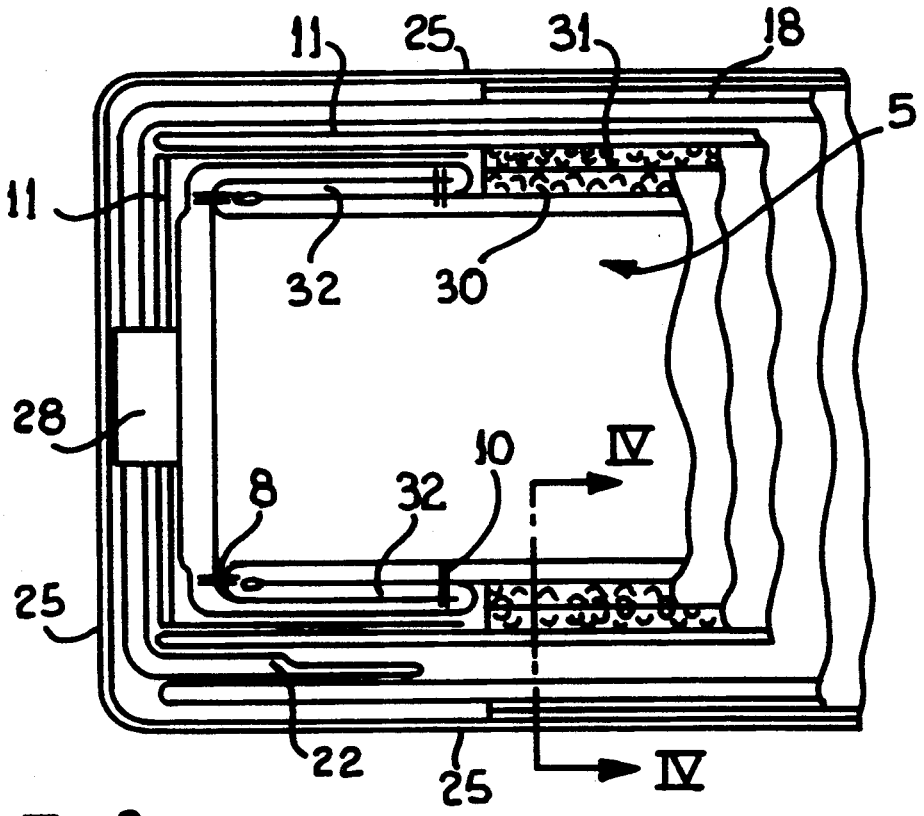
FIG. 3 is a part horizontal section through the bag of FIG. 1 showing how the protective inserts are nested within the bag.
Figure 4:
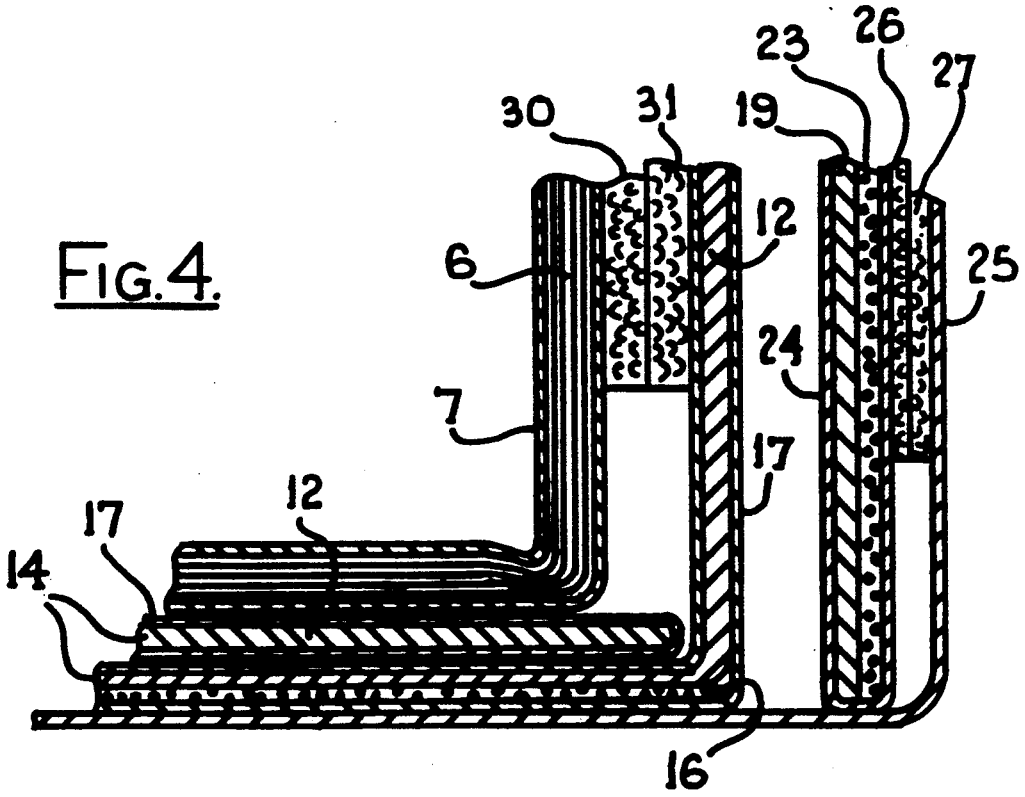
FIG. 4 is a part section along the line IV—IV in FIG. 3 shown to a larger scale.

The bag as shown in FIG. 1 is a lightweight nylon bag of the type used as a sports bag, having carrying handles 1, a shoulder strap 2 and a double zipped panel 3 at the top which provides an opening 4. The walls of the bag, including the bottom, are lined by a number of inserts which make the bag resistant to penetration by bullets from the inside so that a gun can be loaded or unloaded safely within the bag whilst being held therein.

The inserts include an innermost, open-topped container 5 of the same general oblong shape as the bag, composed of multiple layers 6 of a woven aramid material such as KEVLAR that is resistant to penetration by bullets. A laminate of 15 to 35 layers of KEVLAR is formed by stitching the layers together, and is sewn into a nylon cover 7. The blank laminate has an oval shape and is formed into the oblong shape of the container 5 by forming tucks 32 at the corners which are stitched at 8 and folded against the outside of the longer side walls 9 of container 5. Stitching 10 holds the tucks 32 in place against the side walls 9.

Two further inserts 11 are provided outside of the container 5 and comprise two rectangular sheets of polycarbonate 12 each sewn into a nylon cover 17. Each insert is folded twice at 13 to form a bottom wall 14 and two upright walls 15. The two inserts are laid across one another with their bottom walls 14 overlapping beneath the container 5 and with their side walls 15 each lying adjacent the outside of a corresponding side wall of the container 5. The lower of these two overlapping inserts 11 is provided with a sheet of plastics foam 16 against the lower surface of its bottom wall 14. The foam used is cross-linked, dual density polyethylene.

A final insert 18 is provided around the outside of the two inserts 11 and comprises a rectangular sheet of polycarbonate 19 with four parallel folds 20 along its length so as to form four walls 21 each lying adjacent a corresponding side wall 15 of the two inner inserts 11, and an overlapping end portion 22. Further, a rectangular sheet of cross-linked, dual density polyethylene foam 23 is provided against the outer surface of the polycarbonate sheet 19 over the whole of its area, including the corner folds, but excluding part of the overlapping end portion 22. This insert 18 is sewn into a nylon cover 24.

A number of hook and felt tape fasteners such as those sold under the trade mark VELCRO are used to fasten the inserts to one another and to the inside of the bag. During assembly, the outermost insert 18 is inserted into the bag and is a close fit with the side walls 25 of the bag. Felt tapes 26 sewn to the cover 24 on the outside of the opposite side walls 21 of the insert 18, engage and grip hooked tapes 27 sewn to the adjacent side walls 25 of the bag. The lower insert 11 having the bottom wall 14 with a foam sheet 16 is inserted into the bag followed by the second insert 11 laid across the first. Hooked tapes 28 sewn to the nylon cover 24 on opposite end walls 21 of the outer insert 18 are then dropped down inside the inserts 11 and are engaged with felt tapes 29 sewn to the nylon cover 17 on the inside of the adjacent side walls 15 of the second insert 11. The innermost insert 5 is then inserted into the bag within the other inserts 11, 18, and felt tapes 30 sewn to the nylon cover 7 on the outside of the side walls 9 engage hooked tapes 31 sewn to the nylon cover 17 on the inside of the adjacent side walls 15 of the lower insert 11.

It will be appreciated that the bag described above is provided with a bullet resistant liner which over every part of the side walls and bottom of the bag provides a penetration resistant laminate of KEVLAR material 6, two impact absorbing layers of polycarbonate sheet material 12, 19, and an impact absorbing layer of foamed polyethylene 16, 26. The tucked and folded formation of the KEVLAR material at the corners of the insert 5 avoids any vulnerable regions that would be caused by cuts or seams. Further, the use of a second polycarbonate sheet 19 in the outermost insert 18 serves to cover the breaks at the corners where the side walls 15 of the two inserts 11 meet.

I claim:

1. A bag having a base wall and a plurality of side walls surrounding an internal space, said walls incorporating at least one layer of high tensile strength and high stretch resistance material such as to be capable of resisting penetration by a bullet, said layer comprising a single-piece layer which extends over said base wall and at least two adjacent said side walls and is folded between the base wall and side walls forming tucks in the side walls, there being a tuck between the side walls comprising each adjacent pair of side walls.

2. A bag as claimed in claim 1 in which said walls incorporate at least one layer of an impact absorbing material which is located adjacent to the outer face of said layer of high tensile strength and high stretch resistance material.

3. A bag as claimed in claim 1 in which a single piece of impact absorbing material is folded along two parallel fold lines between one side wall and each said adjacent pair of side walls.

4. A bag as claimed in claim 3 in which two pieces of impact absorbing material are laid one over the other adjacent to said base wall, and each is folded along two parallel fold lines between the base wall and adjacent side walls so that portions thereof extend laterally of said base wall and lie ajacent said side walls.

5. A bag as claimed in claim 3 in which a single piece of impact absorbing material is folded so that it lies adjacent to all said side walls.

6. A bag as claimed in claim 1 in which the high tensile strength and high stretch resistance material comprises an aramid material.

7. A bag as claimed in claim 1 in which the impact absorbing material comprises polycarbonate sheet material.

8. A bag as claimed in claim 1 in which said layer of high tensile strength and high stretch resistance material is removable from the bag.

9. A bag as claimed in claim 1 in which said impact absorbing material is removable from the bag.

10. A bag as claimed in claim 1 in which the bag is provided with carry handles and said opening is provided in a top wall of the bag as carried.

11. A bag as claimed in claim 1 which is elongate in shape and is provided with said opening in a wall of the bag at one longitudinal end thereof.

12. A bag as claimed in claim 1 which includes a removable panel of at least one layer of high tensile strength and high stretch resistance material such as to be capable of resisting penetration by a bullet, said panel being adapted to be fitted to the bag to cover said opening once the bag is loaded by a user.

13. A bag as claimed in claim 1 in which each said tuck is folded flat against an adjacent said side wall.

14. A bag having a base wall and a plurality of side walls surrounding an internal space, said walls incorporating at least one layer of high tensile strength and high stretch resistance material such as to be capable of resisting penetration by a bullet, and two layers of an impact absorbing material which are located adjacent to the outer face of said layer of high tensile strength and high stretch resistance material, said two layers of impact absorbing material being laid one over the other adjacent to said base wall and each being folded along two parallel fold lines between the base wall and adjacent side walls so that portions thereof extend laterally of said base wall and lie adjacent said side walls, the fold lines of one said layer of impact absorbing material being perpendicular to the fold lines of the other said layer of impact absorbing material.

* * * * *